US009121563B2

(12) United States Patent
Schug

(10) Patent No.: US 9,121,563 B2
(45) Date of Patent: Sep. 1, 2015

(54) COLLIMATOR WITH HINGED SIDEWALL

(75) Inventor: Josef Andreas Schug, Eindhoven (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 248 days.

(21) Appl. No.: 13/581,757

(22) PCT Filed: Feb. 24, 2011

(86) PCT No.: PCT/IB2011/050776
§ 371 (c)(1), (2), (4) Date: Aug. 29, 2012

(87) PCT Pub. No.: WO2011/107908
PCT Pub. Date: Sep. 9, 2011

(65) Prior Publication Data

US 2012/0327676 A1 Dec. 27, 2012

(30) Foreign Application Priority Data

Mar. 3, 2010 (EP) ..... 10155316

(51) Int. Cl.
*F21S 8/00* (2006.01)
*F21S 8/10* (2006.01)

(52) U.S. Cl.
CPC ..... *F21S 48/1757* (2013.01); *F21S 48/1154* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 24,285 | A * | 6/1859 | Conlan | 362/320 |
| 1,494,490 | A * | 5/1924 | Larsen | 362/283 |
| 3,019,486 | A * | 2/1962 | Stinson | 264/239 |
| 3,441,975 | A * | 5/1969 | Shepherd | 16/225 |
| 3,445,052 | A * | 5/1969 | Lewallen | 428/158 |
| 5,347,432 | A * | 9/1994 | Chiavetta | 362/18 |
| 5,614,307 | A * | 3/1997 | Andersen et al. | 428/294.7 |
| 7,093,959 | B2 * | 8/2006 | Tsao | 362/277 |
| 7,614,766 | B2 * | 11/2009 | Wang et al. | 362/269 |
| 7,771,092 | B2 * | 8/2010 | Yeh | 362/351 |
| 8,096,670 | B2 * | 1/2012 | Trott et al. | 362/147 |

FOREIGN PATENT DOCUMENTS

| | | | |
|---|---|---|---|
| CN | 201363664 | Y | 12/2009 |
| DE | 10260397 | A1 | 7/2004 |
| DE | 102007014215 | A1 | 9/2008 |
| DE | 102008011180 | A1 | 8/2009 |
| EP | 1925878 | A1 | 5/2008 |
| JP | 6185701 | A | 7/1994 |
| WO | 2008035267 | A2 | 3/2008 |
| WO | 2010076741 | A1 | 7/2010 |

* cited by examiner

*Primary Examiner* — Ismael Negron
(74) *Attorney, Agent, or Firm* — Yuliya R. Mathis

(57) ABSTRACT

A collimator comprising a base, a plurality of side walls and an integral hinge coupled to at least one of the sidewalls to the base and tillable within a range of motion. The collimator is configured such that light emitted by the light source enters the collimator through a light entry opening and exits substantially only through a light exit opening for any position of the hinged side wall over its range of motion. A semiconductor light source may be arranged on a substrate, wherein the collimator encloses the semiconductor light source and an actuator moves the hinged side wall over at least part of its range of motion to adjust the light exit opening.

17 Claims, 4 Drawing Sheets

COLLIMATOR WITH HINGED SIDEWALL

FIELD OF THE INVENTION

The invention describes a collimator, a method of manufacturing a collimator, a lighting assembly comprising such a collimator, and an automotive headlamp arrangement comprising such a lighting assembly.

BACKGROUND OF THE INVENTION

Lighting units or lighting assemblies using semiconductor light sources such as light-emitting diode (LED) chips are becoming more popular as advances in technology have led to economic and yet very bright semiconductor light sources.

In lighting assemblies used in automotive applications, for example, a particular requirement is that the bright/dark cut-off line of the light output by the lighting assembly satisfies certain regulations. Furthermore, this bright/dark cut-off line should be adaptable, for example to raise or lower the beam of light output by the lighting assembly so that a low beam and a high beam can be produced. Adaptability of the light output is also desirable in certain situations, such as when driving into a bend, so that the area in the bend can be better illuminated, with a resulting increase in safety. Furthermore, it may be advantageous to influence the amount of light in the foreground of beam pattern, i.e. in a region of the beam closest to the vehicle, depending on traffic conditions and/or terrain, weather conditions, etc.

Prior art lighting assemblies that implement a movable beam limiter to direct the light output to alter the bright/dark cut-off line, for example in an up or down direction, are known, for example WO 2008/035267 A2, which describes a moveable beam-limiter with a side wall that can be bent to a curved surface. This realization makes use of a collimating reflector together with an additional beam-limiter to alter the shape of the resulting light beam. However, these solutions generally also require additional parts to prevent the light 'escaping' through gaps arising when the beam limiter is moved. The light escaping at the edges results in a beam with diffuse edges, which is undesirable. Furthermore, since not all of the light emitted by the light source passes through the beam limiter, these prior art systems are characterized by a lower efficiency. Also, beam limiter solutions which attempt to solve the problem of the escaping light are rather complex, and are therefore costly to manufacture.

Therefore, it is an object of the invention to provide an alternative, more efficient and more economical lighting assembly.

SUMMARY OF THE INVENTION

The object of the invention is achieved by the collimator of claim 1, by the method of claim 13 of manufacturing a collimator, by the lighting assembly of claim 14, and by the automotive headlamp arrangement of claim 15.

According to the invention, a collimator comprises a base or substructure, and a plurality of side walls arranged to enclose a light source. In the inventive collimator, at least one side wall is joined to the base by an integral hinge and is realized to be tiltable within a range of motion. Furthermore, the base and the side walls of the collimator are realized so that light emitted by the light source enters the collimator through a light entry opening and exits essentially only through a light exit opening for any position of the hinged side wall over its range of motion.

An obvious advantage of the collimator according to the invention is its particularly simple design. Furthermore, this collimator can be manufactured using readily available and cheap materials. The integral hinge, as will be explained below, is of the same material as the collimator, is particularly easy to manufacture and requires no costly machining. Without any overly complicated moving parts, therefore, a collimator can be realized to have a dynamic cut-off while at the same time ensuring that no light is lost, in particular in the region of the integral hinge. The collimator according to the invention therefore particularly suitable for use in automotive applications requiring dynamic cut-off adaptation, for example depending on vehicle load, acceleration/deceleration, crest/hill position, etc.

According to the invention, the method of manufacturing a collimator comprises the step of manufacturing parts of the collimator in an injection-molding process, to give a collimator comprising a base and a plurality of side walls arranged to enclose a light source, of which at least one side wall of the collimator is joined to the base by an integral hinge and is realized to be tiltable within a range of motion, and wherein the base and the side walls of the collimator are realized so that light emitted by the light source enters the collimator through a light entry opening and exits essentially only through a light exit opening for any position of the hinged side wall over its range of motion.

Since injection molding is an established manufacturing technique for rapidly manufacturing large quantities of items, and the materials used in injection molding can be inexpensive, the manufacture of the collimator according to the invention can be particularly economical. A mould for an injection-molding apparatus can be prepared to give a collimator molding blank having a hinged side wall with an integral hinge after injecting a polymer into the mould. One or more side walls and/or a base of the collimator molding blank can subsequently be manipulated to form the body of the collimator.

According to the invention, a lighting assembly comprises a semiconductor light source arranged on a substrate; such a collimator realized to enclose the semiconductor light source; and an actuator for moving a hinged side wall of the collimator over at least part of its range of motion to adjust the light exit opening of the collimator.

Such an entire lighting assembly, even an assembly using an array of LED chips and collimators, can be advantageously small in size. Since the hinged side wall of the collimator can be easily moved about the integral hinge, an actuator comprising a small electromechanical motor such as a micromotor can be sufficient to adjust the light exit opening and therefore the cut-off of the collimator.

According to the invention, an automotive headlamp arrangement comprises such a lighting assembly, and a secondary optic.

The dependent claims and the following description disclose particularly advantageous embodiments and features of the invention. Features of the embodiments may be combined as appropriate.

In the following, using the usual convention, any references to the "bottom of the collimator" refer to the end of the collimator nearest the substrate on which it is mounted, and any references to the "top of the collimator" refer to that end of the collimator nearest the light exit opening. Also, without restricting the invention in any way, it is assumed in the following that the light source arranged within the collimator comprises a semiconductor light source. The 'light entry opening' is to be understood to be the level at which the light effectively enters the collimator. For example, the light entry opening may be the level at which the base adjoins the side walls. Equally, if the light source is positioned at least partially within the collimator body, the light entry opening can be regarded as the level or boundary at which the light is emitted from the light source into the collimator. Similarly, the 'light exit opening' can be regarded as the plane defined essentially by the upper edges of the collimator side walls, and the light exit opening can be made larger or smaller by the movement of the hinged side wall.

An "integral hinge" can be realized in a number of ways. In one approach, the tiltable side wall and the base can be manufactured separately. Along one edge of the light entry opening, the base can be realized to have a thin 'curl' of material. A side wall can be realized so that the edge that is to fit into the curl is appropriately rounded, for example in the manner of a rounded protrusion along the edge of the side wall. By appropriate choice of the dimensions, the curl can be snapped onto the rounded protrusion to give a tight fit.

In a particularly simple and preferred solution, however, at least the side wall and base are made of one piece, and the integral hinge of the hinged side wall preferably comprises a region of reduced material thickness between the hinged side wall and the base of the collimator. The region of reduced material thickness can be a thin strip of material remaining to connect the hinged side wall and the base. Because of the thinness of this region, the side wall can easily be moved back and forth, and the thin strip acts as an elastic integral hinge. One advantage of such a one-piece manufacturing is that the hinged side wall cannot be inadvertently detached from the base. When manufactured in an injection molding process, such a hinge is also referred to as an "in-mould hinge" or a "living hinge". The region of reduced material thickness could of course also be obtained from a blank of uniform thickness, by removing material between two regions of the blank to give a groove of a certain depth, leaving only a thin strip of material connecting one region of the blank and the other region of the blank.

Semiconductor light sources of small dimensions and with very bright light output can be manufactured using present-day technology. The actual dimensions of the semiconductor light source to be used in a lighting assembly will generally also be governed by factors such as the focal length of the optical system with which the light source is to be used. Therefore, the area of the light entry opening of the collimator (in which the semiconductor light source is placed), in a preferred embodiment of the invention, is preferably less than 120 $mm^2$ (e.g. 4 mm×30 mm), more preferably less than 12 $mm^2$ (e.g. 2 mm×6 mm), and most preferably less than 6.75 $mm^2$ (e.g. 1.5 mm×4.5 mm). Because of its small size, a collimator of these dimensions may be referred to as a "micro-collimator". A lighting assembly can comprise a single such collimator and light source, or even an array of collimators and light sources, depending on the application and the required light output.

The surface area of the light-emitting surface of a semiconductor light source, such as an LED chip may have dimensions in the order of 0.5 mm×0.5 mm to 2.0 mm×2.0 mm, and may be grouped in arrays. Arrays of 1×2 chips or even 4×32 chips have been shown. Arrays of 1×4 chips or 1×5 chips are quite common in automotive applications. In general, the spacing between the individual chips is quite small in order to allow the array to be regarded as a single rectangular light source. LED chips with rectangular areas can be used, so that these can be easily arranged in an overall rectangular shape with little or no gaps between the individual chips. Thin-film chips can have a thickness of only a few micrometers. The sides of the chips can be enclosed in a highly reflective material such as titanium dioxide so that any light generated in the chip is forced to exit the chip only through its upper surface. 'White' LEDs typically comprise a luminescent material (phosphor) converting blue light emitted from the chip at least partially to light of a shorter wavelength—typically yellow—which combined with the blue light gives a white light. Such luminescent material can be applied as phosphor grains embedded in a transparent matrix of a suitable material such as silicone. It can also comprise a ceramic matrix material with an embedded luminescent material. The luminescent material can be applied to each individual LED chip of an array, but could equally well be applied as a shared element covering multiple chips. The luminescent material can be applied directly onto a chip or at a certain distance (so-called 'remote phosphor'), whereby a close proximity to the chip is usually preferred. Using a remote phosphor has the advantage of a thermal decoupling between the chip (which can become very hot during operation, reaching temperatures in the region of 180° C.) and the phosphor, which may otherwise deteriorate over time as a result of exposure to high temperatures. It also has the advantage of protecting other elements, for example the collimator, from detrimental exposure to high temperatures. The term 'light source' in the following is to be interpreted as an arrangement comprising the chip(s) that actually generate light together with any such coating or luminescent layer applied to an individual chip or to the chips of an array.

A collimator enclosing such a chip/luminescent material arrangement is preferably realized to accommodate it in a fairly snug fit. Therefore, in a preferred embodiment of the invention, the collimator comprises an essentially rectangular cross-section. A rectangular shape of the collimator implies that the light entry opening and light exit opening are also rectangular in shape.

The collimator according to the invention is preferably realized using a minimum number of parts. One or more parts can be in the form of a blank which is bent into shape. For example, in the 'snap-on' hinge described above, the collimator could be manufactured using only two blanks which are bent appropriately and then fitted together. In a particularly preferred embodiment of the invention, the collimator is made using a single blank, i.e., in a one-piece manner, and the tiltable side wall is connected to the base by an in-mould or living hinge. The collimator could also be realized using different types of materials chosen according to their function. For example, a favorably flexible and robust material such as a carbon-fiber reinforced material or a thin metal foil can be used for the hinged part, since this will be subject to the most wear during the lifetime of the lamp. A stiffer material can be used for the remaining 'rigid' parts such as the collimator side walls and the base.

As mentioned already, the collimator according to the invention is preferably realized so that essentially no light escapes from the sides or hinge. A light-tight collimator can be achieved in a number of ways. In one embodiment of the collimator according to the invention, the hinged side wall comprises an apron extending from the light entry opening to the light exit opening and which is realized to overlap an adjacent collimator side wall in a light-tight manner over the range of motion of the hinged side wall. The apron therefore moves with the tilting side wall while remaining in contact with the adjacent side wall. The overlap advantageously ensures that no light can escape through the sides of the collimator. To ensure a light-tight contact between the apron and the adjacent side wall, these can be realized to be in close contact over the entire apron area. Also, one or more of these surfaces could, for instance, be coated at least partially with a suitable material such as a flocking or felted textured surface which can provide the desired light-tight effect without an overly high level of friction. Preferably, for an essentially rectangular collimator, the hinged side wall has such an apron on two of its sides. The base might also comprise one or more additional aprons, depending on the realization of the collimator, to ensure that no light escapes from the edges when the hinged side wall is moved.

In an alternative realization of a collimator according to the invention, the hinged side wall of the collimator is connected in a light-tight manner to a pair of opposing side walls, which opposing side walls comprise a number of pleats to accommodate the range of motion of the hinged side wall. The pleats could be formed by a thermal crimping step so that, advantageously in this realization, the entire collimator and base can be realized in one piece. The pleats on such a side wall can be realized to have some depth at the top of the side wall and to taper to a flat plane towards the base of the side wall. In this way, the adjoining hinged side wall is free to be tilted about its bottom edge.

In another possible realization, the collimator according to the invention comprises a hinged side wall arranged in a light-tight manner between a pair of opposing side walls, which opposing side walls extend essentially at right angles beyond the hinged side wall to accommodate the range of motion of the hinged side wall. Of course, in any of the possible embodiments described above, the collimator can have more than one hinged side wall. For example, in the embodiments with lateral side walls that are pleated or lateral side walls that are extended, two opposite hinged side walls could easily be realized between these lateral side walls, so that the light entry opening can be regulated to a greater extent, should this be desired.

As already indicated above, it is of course desirable to maintain, as far as possible, the efficiency of the semiconductor light source. Therefore, in a further preferred embodiment of the invention, at least the interior surfaces of the collimator are at least partially highly reflective. Furthermore, it is preferable if at least the upper part of the collimator exhibits specular reflectivity to achieve a collimating effect of the light emitted from the light source. Preferably, any reflective surfaces of the collimator are highly reflective. For example, the collimator side walls can be made of a highly reflective material or given a highly reflective coating on their inside faces, such as a coating of aluminum, silver or a titanium dioxide "filled" lacquer.

The type of actuator used to move the collimator over its range of motion will depend largely on the geometry and dimensions of the collimator actually realized. For example, an actuator could be a 'nose' or lever to act upon a distal or 'upper' edge of the collimator, i.e. an edge along its light exit opening. Preferably, the actuator is realized to tilt the hinged side wall of the collimator about an axis of rotation, so that the hinged side wall is tilted forward or back. Suitable examples might an electromechanical lever, a spring element, etc. The actuator can be physically connected to the collimator. However, depending on the choice of material, the integral hinge of the collimator may exhibit an elastic behavior. In this case, an actuator may only be needed to move the hinged side wall from its 'resting' position to another position. When released, the hinged side wall may then return to its resting position of its own accord. Such an actuator can be particularly simple to realize, since no physical connection is required between the actuator and the hinged side wall.

An actuator can be associated with a single collimator of a lighting assembly, or can be realized to control a plurality of collimators of neighboring lighting assemblies. For example, in a regular arrangement of collimators, a single rod-shaped actuator can be arranged alongside the hinged side walls of a row of collimators. The rod can have a number or projections or 'noses', each corresponding to a hinged side wall. To push the hinged side walls inward and therefore to reduce the light exit openings of the collimators in that row, the actuator rod need only be rotated sufficiently for the 'noses' to push the hinged walls inward. The hinged side walls can return to their resting state by simply rotating the actuator by an appropriate amount again, so that the light exit openings are once more increased.

As indicated above, it is favorable to be able to control several collimators simultaneously. This can be facilitated by designing the collimators to have a regular shape (for example rectangular as described above), and by positioning the hinged side wall along a suitable side of the collimator. Therefore, in a preferred embodiment of the collimator according to the invention, the axis of rotation of the hinged side wall of the collimator is essentially parallel to an edge of the light entry opening.

The collimator can be made using any suitable manufacturing technique. For example, the side walls can be individually stamped or cut out of a material such as plastic, sheet metal etc., or can be otherwise formed. However, this type of assembly may be time-consuming and relatively expensive.

Therefore, in a particularly preferred embodiment of the collimator according to the invention, the collimator is manufactured in an injection molding process using a suitable material such as a thermoplastic. In such a process, the integral hinge can easily be achieved by appropriate design of the mould. Furthermore, using such a manufacturing technique, a light-tight joining of side walls to base is readily achievable. As a further advantage, the lower edge of the hinged side wall can be aligned to a base with very favorably tight tolerances. Depending on the collimator design, as described above, the collimator can be made in one piece, or of two or more parts joined together. For example, in the case of the collimator with aprons on the hinged side wall, a one-piece injection molding process is possible with appropriate design of the mould. For the collimator with pleated side walls, a one-piece realization is also feasible. The pleats can be formed in the injection molding process, or could be formed in a second stage by heating those side walls and crimping them, which can also have the added advantage of making these side walls thinner. In the case of the collimator with extended side walls, the hinged side walls can be formed with a part of the base, while the other side walls are formed with the remainder of the base. These parts can then be glued, welded or otherwise connected, for example by combining this stage with the step of gluing or otherwise attaching the collimator to the substrate.

As indicated above, a material with a certain degree of elasticity may give an integral hinge with particularly favorable properties. Therefore, in a further preferred embodiment of the invention, the material of the collimator comprises a polymer, preferably a thermoplastic. This type of material is particularly suited to an injection molding process, and a collimator made of such a material can have a hinged side wall with an integral hinge that allows ease of movement. A suitable material preferably has favorable thermal properties, for example a melting point higher than the temperatures generated by the light source. The choice of material may also to some extent depend on whether or not the light source comprises a remote phosphor. A suitable material may be a high-temperature polyamide such as Stanyl® (manufactured by DSM), which is widely used in the automotive industry.

A certain flexibility is desired in the region of the integral hinge, which should allow the hinged side wall to be moved easily during operation over the lifetime of the LED. However, a material that has favorable thermal properties may be associated with an unfavorable elasticity. Even so, a material with less favorable thermal properties (e.g. less flexible when heated) could be used for a collimator enclosing a light source comprising a remote phosphor, since the remote phosphor effectively acts as a thermal decoupler between the hot LED and the collimator, thus protecting the integral hinge from the heat originating from the LED.

The design of the base of the collimator may depend on the type of semiconductor light source being used. For example, if an edge-emitting chip is used, this is preferably surrounded on all sides by highly reflective inside surfaces. In such an embodiment, the thickness or height of the base or substructure of the collimator is preferably at least as high as the semiconductor, so that as much light as possible is directed out of the collimator. However, advances in semiconductor light source technology have led to the development of highly efficient surface emitting LED chips, for example ceramic surface-emitting diodes. Since such a chip does not emit from its sides, and is only in the order of 100 μm in depth, the base of a collimator enclosing the chip can be favorably thin. This can also be an advantage in an injection-molding process, which gives best results for objects of homogenous thickness. Therefore, in a particularly preferred embodiment of the invention, the lighting assembly comprises a surface-emitting semiconductor light source. Preferably, the thickness of the collimator side walls and base is between 0.1 mm and 3 mm, preferably between 0.5 mm and 1 mm.

Although the preferred embodiments of the inventions primarily address a dynamic adaption of the light/dark boundary in the vertical direction of the beam pattern (commonly referred to as the 'cut-off line'), this should not be seen as a limitation of the scope of the invention. Specifically, further potential applications of the invention might be a switching between low beam and high beam, an adjustment of the horizontal width of the beam distribution and a controlling of the light-beam in the foreground (i.e. close to the vehicle).

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
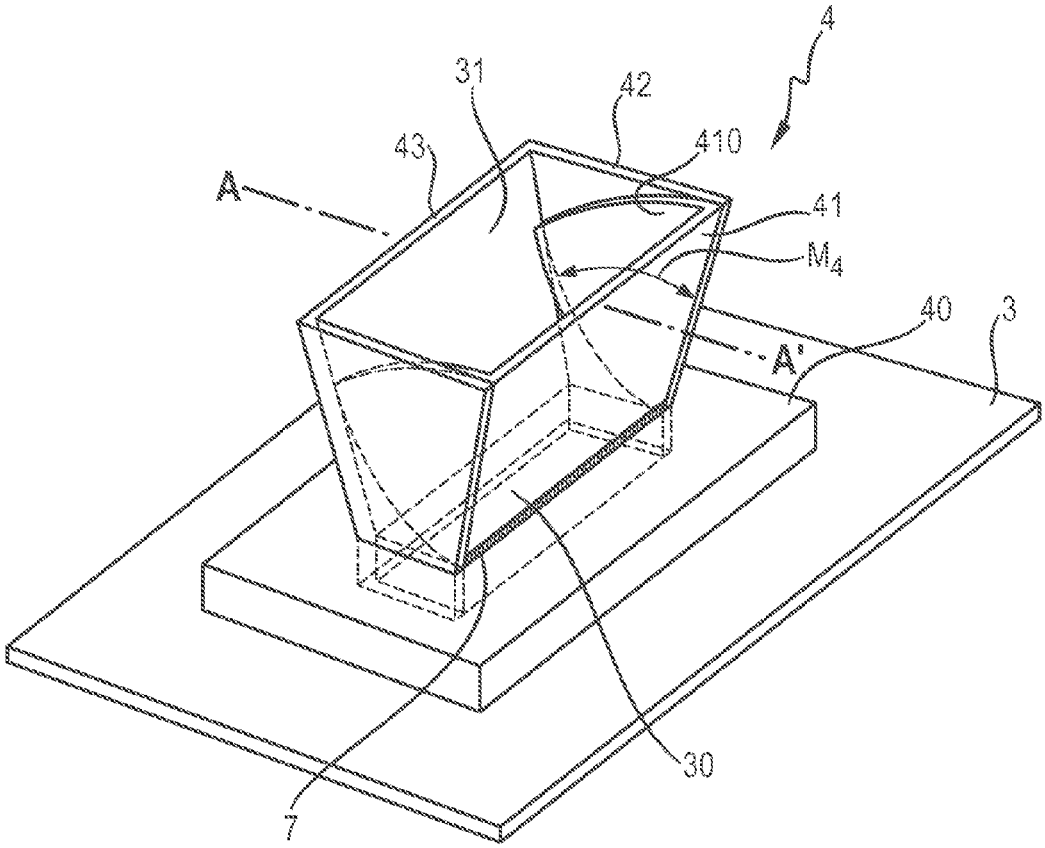
FIG. 1 shows a schematic view of a collimator according to a first embodiment of the invention.

FIG. 1 shows a schematic view of a collimator 4 according to a first embodiment of the invention, arranged on a substrate 3. The collimator 4 comprises a base 40 and side walls 41, 42, 43 arranged to give an essentially rectangular body enclosing an empty area 30 within the base 40 in which a semiconductor light source can be arranged (not shown in the diagram). The side walls 41, 42, 43 and base 40 are formed in a light-tight manner. In this embodiment, one side wall 41 comprises an integral hinge 7 along the width of the side wall 41. The hinge 7 allows the side wall 41 to be tilted forward or back over a range of motion $M_4$ as indicated by the arrow. To ensure that no light escapes at the side walls 41, 42, 43, the hinged side wall 41 comprises lateral 'aprons' 410 arranged to overlap the pair of side walls 42 between which the hinged side wall 41 is arranged. In this diagram, the aprons 410 are shown to be on the inside of the collimator 4. Of course, the aprons 410 could equally well be arranged on the outside, so that the side walls 42 are on the inside. As the hinged side wall 41 is tilted outward by the action of an actuator, the apron 410 ensures that light cannot escape at the sides, so that any light emitted by a light source enclosed by the collimator 4 can only exit through the light exit opening 31 of the collimator 4. For the sake of simplicity, an actuator to move the hinged side wall 41 is not shown here. The light source enclosed by the collimator 4 can be any suitable light source, for example an edge-emitting semiconductor light source, and the inside surfaces of the base and side walls can be treated to be highly reflective, so that as much light as possible can exit through the light exit opening 31. In this and in the following diagrams, the hinged side wall is shown to be flat for the sake of clarity. Evidently, the hinged side wall can have any suitable shape, depending on the application for which it the collimator is intended.

Figure 2:
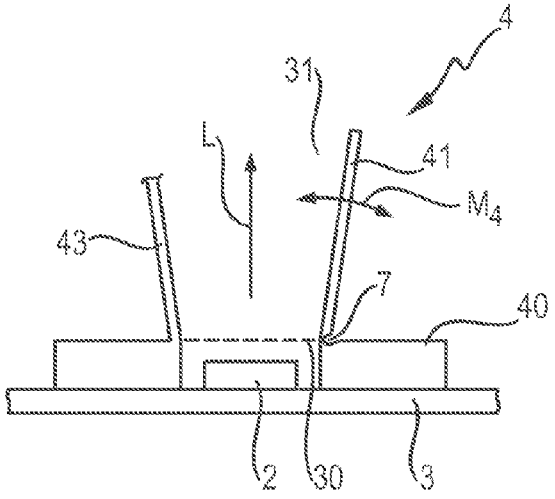
FIG. 2 shows a simplified cross-sectional side view of the collimator of FIG. 1.

FIG. 2 shows a simplified cross-sectional side view of a collimator 4 as described in FIG. 1, taken along A-A'. Here, a substrate 3 bears a semiconductor light source 2 such as a ceramic edge-emitting LED arranged within the base 40 of the collimator 4. Light L generated by the semiconductor light source 2 enters the collimator 4 through a light entry opening 30 and exits through a light exit opening 31. A side wall 41 of the collimator 4 is joined to the base 40 by means of a region 7 of reduced material thickness extending along one edge of the light entry opening 30 (which is indicated by the broken line) and acting as an integral hinge 7, allowing the hinged side wall 41 to be tilted over a range of motion $M_4$ as indicated by the arrow. In this realization, the opposing side wall 43 is fixed rigidly to the base 40 and does not move. In this diagram, the opposing side wall 43 is shown to be shorter than the hinged side wall 41. Of course, the relative heights of the side walls 41, 43 can be chosen according to the application for which the collimator 4 is to be used. The light exit opening 31 is adjusted or regulated by the hinged side wall 41. The default or resting position of the hinged side wall 41 is such that the light exit opening 31 is smallest. The hinged side wall 41 can be pulled outward by an actuator (not shown). Owing to the elastic behavior of the integral hinge, the hinged side wall 41 returns to its original position when released by the actuator.

Figure 3:
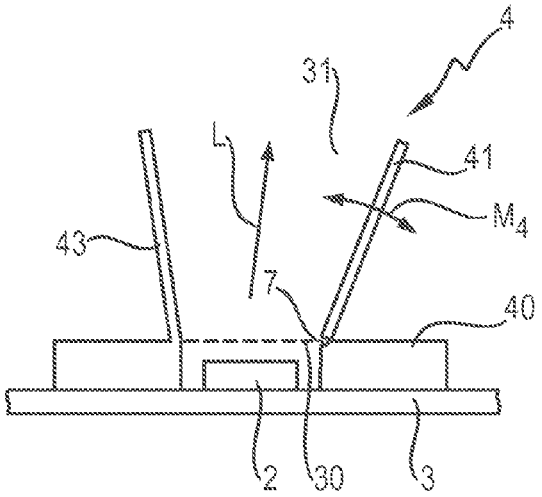
FIG. 3 shows an alternative realization of an integral hinge in a collimator according to the invention.

In FIG. 3, an alternative integral hinge realization is shown as a cross-section in the manner of FIG. 2. Here, the region 7 of removed material is on the inside of the collimator 4 extending along one edge of the light entry opening 30. In this realization, the default position of the hinged side wall 41 is such that the light exit opening 31 is largest. An actuator (not shown) can push the hinged side wall 41 inwards to reduce the size of the light exit opening 31.

Figure 4:
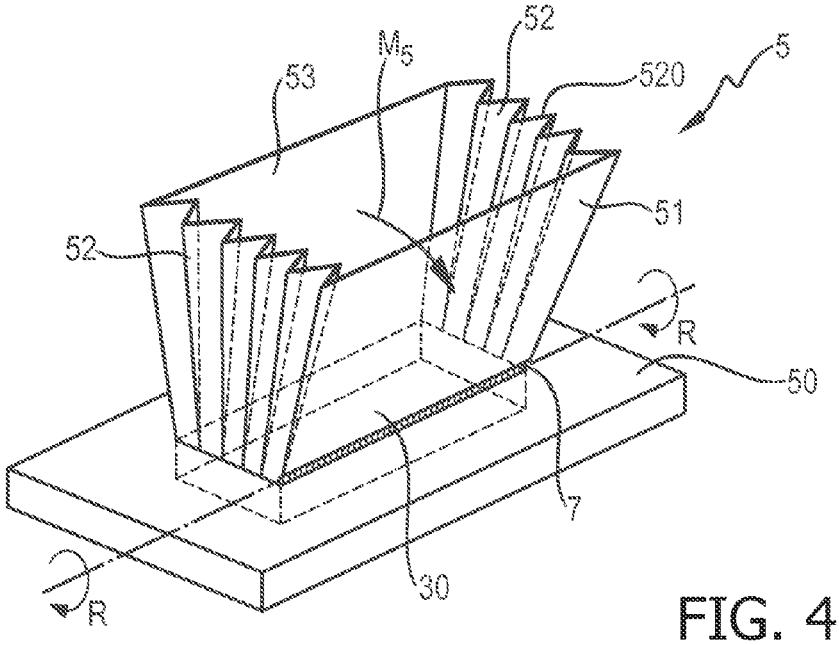
FIG. 4 shows a collimator according to a second embodiment of the invention.

FIG. 4 shows an alternative realization of a collimator 5 according to the invention. Here, a base 50 is connected to a number of side walls 51, 52, 53. At the base of one side wall 51, a region 7 of reduced material thickness acts as an integral hinge 7. To allow the hinged side wall 51 to be tilted, this side wall 51 is arranged between a pair of pleated side walls 52 and connected to these in a light-tight manner. The pleats 520 allow the effective area of such a side wall 52 to be increased or decreased as desired in the manner of a bellows. By realizing the pleats 520 to taper towards the base 50, the hinged side wall 51 can tilt, over a range of motion $M_5$, about an axis of rotation R lying along an edge of the light entry opening 30 in the base 50, which edge essentially coincides with the integral hinge 7.

Figure 5:
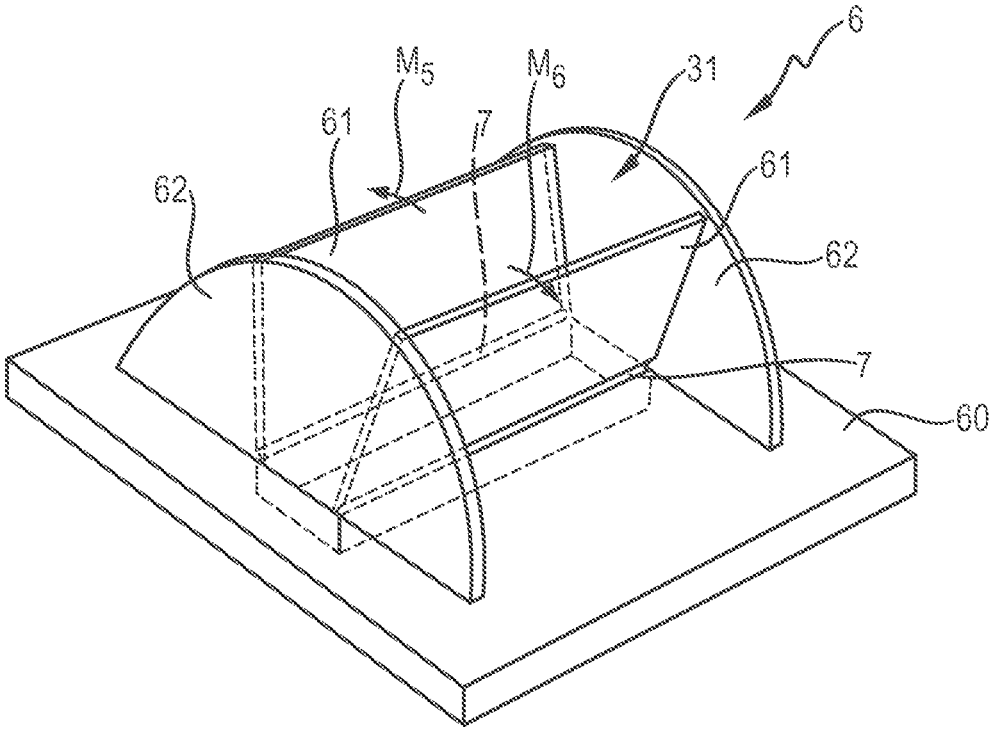
FIG. 5 shows a collimator according to a third embodiment of the invention.

FIG. 5 shows another realization of a collimator 6 according to the invention. Here, a pair of opposing hinged side walls 61 is connected to a base 60 by means of integral hinges 7 in the manner described above. In this realization, light is prevented from escaping at the sides by a pair of extended side walls 62. These extended side walls 62 are arranged and dimensioned to accommodate a range of motion $M_6$ of the hinged side walls 61 when one or both of these are tilted by an actuator (not shown in the diagram).

Figure 6:
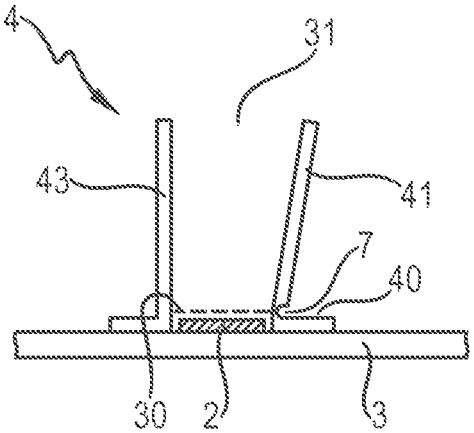
FIG. 6 shows a collimator according to a fourth embodiment of the invention.

FIG. 6 shows another realization of a collimator 4 according to the invention. Here, the base 40 simply comprises a narrow surround of the same thickness as the body of the collimator 4. Such a realization is particularly advantageous, since an injection-molding process gives optimal results for uniform material thickness. Furthermore, advances in semiconductor light source technology are leading to the production of surface-emitting thin-film laser diodes 2 which can be realized with a thickness of only a few micrometers. For such thin LEDs, a reflective 'recess' about the sides of the light source is not required, and the base of the collimator can be realized to be quite flat or thin as shown here. The thickness of the collimator 4 can be in the order of about 0.5 mm. The light entry opening 30 and light exit opening 31 are indicated in the same manner as in the previous diagrams.

Figure 7:
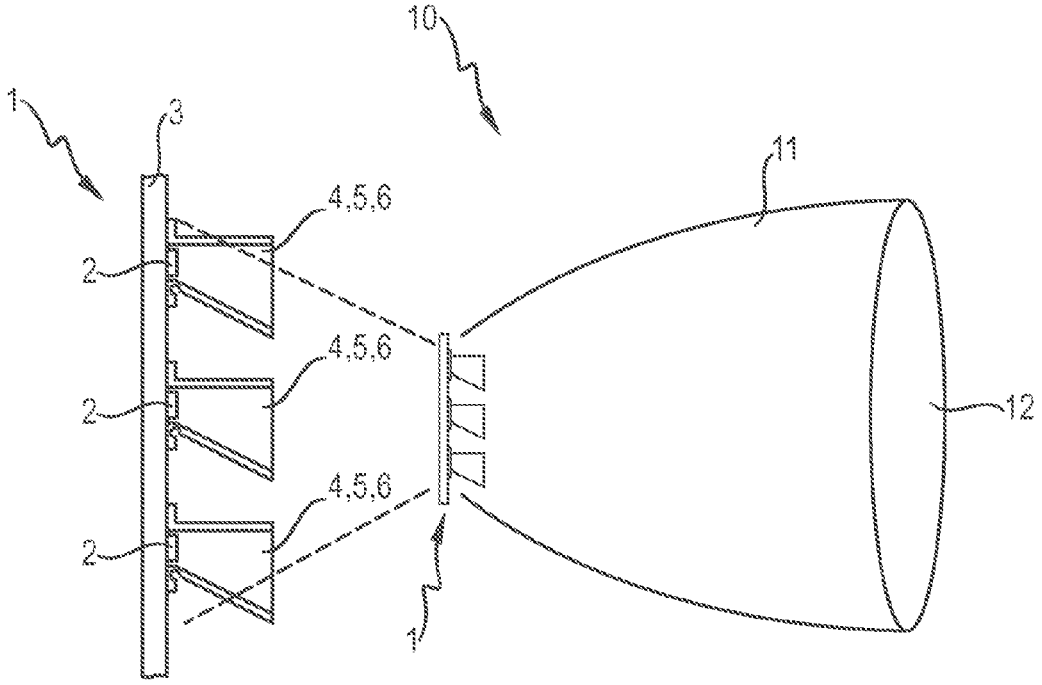
FIG. 7 shows a cross-section of an automotive headlamp arrangement comprising an array of lighting assemblies according to the invention.

FIG. 7 shows, in cross-section, a realization of an automotive headlamp arrangement 10 comprising a lighting assembly 1 according to the invention 1 with an array of light sources 2, a reflector 11, and a secondary optic 12. On the left-hand side of the diagram, the lighting arrangement 1 is shown enlarged for the sake of clarity. Here, an arrangement is shown having three rows of semiconductor light sources 2 on a substrate 3, each with a collimator 4, 5, 6 with a side wall that can be tilted in the manner already described. Other realizations are equally possible, for example an arrangement of a collimator array and reflector, or an arrangement of a collimator array and a lens, whereby in each case the reflector or lens is shaped to project the light originating from the collimators in the desired direction.

Figure 8:
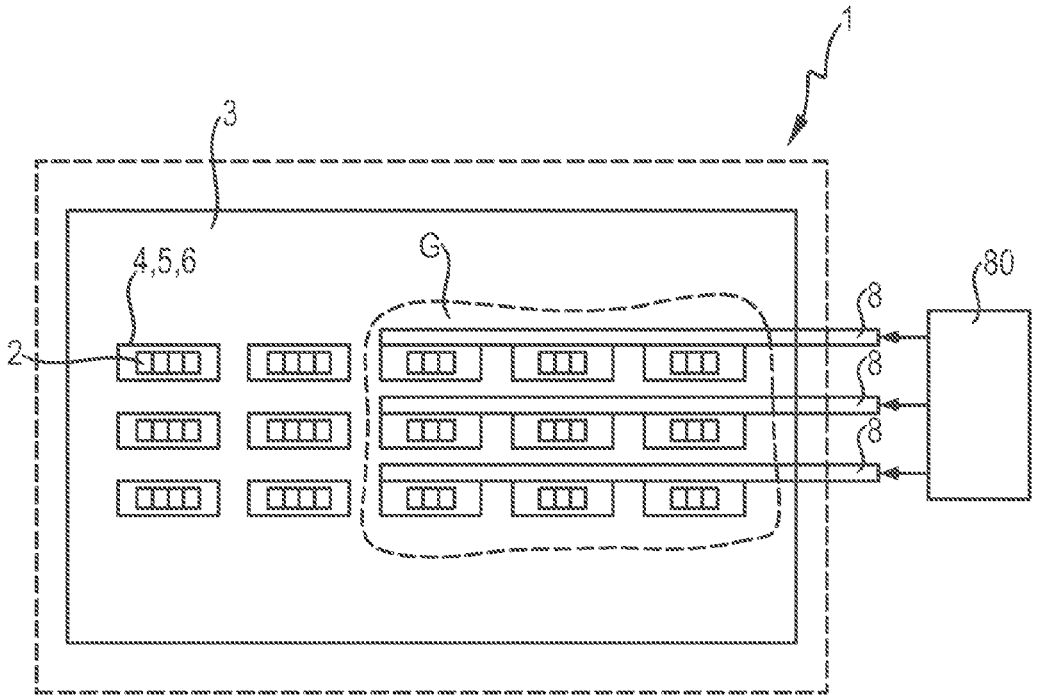
FIG. 8 shows a plan view of the array of lighting assemblies of the automotive headlamp arrangement of FIG. 7.

FIG. 8 shows a plan view of the lighting assembly 1 of the automotive headlamp arrangement 10 of FIG. 7, illustrating the choice of arrangement of the light sources 2 in the lighting assembly. Here, for the sake of clarity, only a single semiconductor light source 2 and collimator 4, 5, 6 are indicated by reference numbers, however, it is to be understood that the array shown in the diagram comprises a plurality of such light sources and collimators. In the headlamp arrangement shown in these diagrams, the shape of the output beam of light, i.e. the light pattern, is directly influenced by the arrangement of the lighting assemblies 1 within the array. The actuators 8 of a number of collimators in a group G can be controlled electromechanically by a controller 80, such that the hinged walls of the collimators in the group G are synchronously tilted. Evidently, such an automotive headlamp arrangement 10 can comprise more than one such array and more than one controller, so that actuators of each group are controlled independently of the actuators of the other group(s).

Although the present invention has been disclosed in the form of preferred embodiments and variations thereon, it will be understood that numerous additional modifications and variations could be made thereto without departing from the scope of the invention. For example, the location of the hinged side wall at a particular position in one of the above Figures does not limit the invention to this specific embodiment. The collimator shape and the position of one or more hinged side walls and the realization of the actuator can be chosen according to the optical system and the desired effect of beam manipulation, for which a variety of combinations may be desirable. Furthermore, it is conceivable that a hinged side wall is held stationary while the rest of the collimator is moved by the actuator. Such a collimator may be realized to enclose the substrate and any circuitry required to drive the semiconductor light source. The actuator may act to move the collimator relative to the hinged side wall. Furthermore, the cross-sectional shape of collimator and light entry/exit openings are not limited to the rectangular shape described herein, but can take on any appropriate shape to suit the design of the lighting assembly.

For the sake of clarity, it is to be understood that the use of "a" or "an" throughout this application does not exclude a plurality, and "comprising" does not exclude other steps or elements.

The invention claimed is:

1. A collimator comprising:
a base;
a plurality of side walls arranged to enclose a light source; and
an integral hinge,
wherein at least one side wall of the plurality of side walls is a hinged sidewall coupled to the base by the integral hinge and wherein the hinged side wall is tiltable within a range of motion, and the base and the side walls of the collimator are configured so that light emitted by the light source enters the collimator through a light entry opening and exits substantially only through a light exit opening for any position of the hinged side wall over the range of motion,
wherein the hinged side wall of the collimator is connected in a light-tight manner to a pair of opposing side walls, which opposing side walls comprise a number of pleats to accommodate the range of motion of the hinged side wall.

2. A collimator comprising:
a base;
a plurality of side walls arranged to enclose a light source; and
an integral hinge,
wherein at least one side wall of the plurality of side walls is a hinged sidewall coupled to the base by the integral hinge and
wherein the hinged side wall is tiltable within a range of motion, and
the base and the side walls of the collimator are configured so that light emitted by the light source enters the collimator through a light entry opening and exits substantially only through a light exit opening for any position of the hinged side wall over the range of motion,
wherein the light exit opening is made larger or smaller by movement of the hinged side wall, and
wherein the hinged side wall of the collimator comprises an apron extending from the light entry opening to the light exit opening and which is configured to overlap an adjacent collimator side wall in a light-tight manner over the range of motion of the hinged side wall.

3. A collimator according to claim 2 wherein at least the interior surfaces of the collimator are at least partially reflective.

4. A collimator according to claim 2, wherein the axis of rotation of the hinged side wall of the collimator is substantially parallel to an edge of the light entry opening.

5. A collimator according to claim 2, wherein the hinged side wall is arranged between a pair of opposing side walls, such opposing side walls extend substantially perpendicularly beyond the hinged side wall to accommodate the range of motion of the hinged side wall.

6. A collimator according to claim 2, wherein the integral hinge of the hinged side wall comprises a region of reduced material thickness between the hinged side wall and the base of the collimator.

7. A collimator according to claim 2, wherein the area of the light entry opening of the collimator is less than 120 $mm^2$.

8. A collimator according to claim 2, comprising a substantially rectangular cross-section.

9. A collimator according to claim 2, wherein the area of the light entry opening of the collimator is less than 12 $mm^2$.

10. A collimator according to claim 2, wherein the area of the light entry opening of the collimator is less than less than 6.75 $mm^2$.

11. A lighting assembly comprising a semiconductor light source arranged on a substrate;

a collimator according to claim 2 configured to enclose the semiconductor light source;

and an actuator for moving the hinged side wall of the collimator over at least part of the range of motion to adjust the light exit opening of the collimator.

12. An automotive headlamp arrangement comprising a lighting assembly according to claim 11, and a secondary optic.

13. A collimator according to claim 2, wherein the material of the collimator is suitable for an injection molding process.

14. A collimator according to claim 13, wherein the material of the collimator comprises a thermoplastic.

15. A collimator according to claim 13, wherein the material of the collimator comprises a polymer.

16. A collimator according to claim 15, wherein the material of the collimator comprises a material having a melting point of at least 160° C.

17. A method of manufacturing a collimator, comprising a base and a plurality of side walls arranged to enclose a light source, wherein at least one side wall of the collimator is a hinged sidewall coupled to the base by an integral hinge and is configured to be tiltable within a range of motion, and wherein the base and the side walls of the collimator are configured so that light emitted by the light source enters the collimator through a light entry opening and exits substantially only through a light exit opening for any position of the hinged side wall over its range of motion wherein the light exit opening is configured to be made larger or smaller by movement of the hinged side wall, and wherein the hinged side wall of the collimator comprises an apron extending from the light entry opening to the light exit opening and which is configured to overlap an adjacent collimator side wall in a light-tight manner over the range of motion of the hinged side wall;

the method comprising the step of manufacturing parts of the collimator in an injection-molding process.

* * * * *